US005277092A

United States Patent [19]

Kinta

[11] Patent Number: 5,277,092

[45] Date of Patent: Jan. 11, 1994

[54] SHEET CUTTING APPARATUS

[75] Inventor: Shuji Kinta, Wakayama, Japan

[73] Assignee: Shima Seiki Mfg., Ltd., Wakayama, Japan

[21] Appl. No.: 946,684

[22] Filed: Sep. 18, 1992

[30] Foreign Application Priority Data

Sep. 18, 1991 [JP] Japan ..... 3-238260

[51] Int. Cl.[5] ..... B26D 7/01; B26D 7/27

[52] U.S. Cl. ..... 83/100; 83/451; 83/941; 210/90; 210/253; 210/340

[58] Field of Search ..... 83/100, 451, 941; 29/77, 84, 94; 210/90, 411, 253, 340

[56] References Cited

U.S. PATENT DOCUMENTS 4,332,679 6/1982 Hengst et al. ..... 210/90
4,343,697 8/1982 Miller et al. ..... 210/90
4,659,483 4/1987 Gries ..... 210/90
5,062,334 11/1991 Killilea et al. ..... 83/100

FOREIGN PATENT DOCUMENTS 51245 3/1988 Japan ..... 83/100

*Primary Examiner*—Hien H. Phan
*Attorney, Agent, or Firm*—Edwin E. Greigg; Ronald E. Greigg

[57] ABSTRACT

A sheet cutting apparatus comprising a sheet feeding table, a cutting table and a sheet take-up table. Air lines, filters in the lines and air pumps draw air from the cutting table to collect any dust, etc. The air passes through filters, then to the blowers and from the blowers air is directed outwardly to the sheet feeding table and take-up table which lifts the material from the table. First and second pressure sensors are provided to detect the pressure to the blower and when a pressure difference exceeds a specific level an alarm is sounded to provide a warning. Then the filters can be cleaned.

4 Claims, 9 Drawing Sheets

SHEET CUTTING APPARATUS

BACKGROUND OF THE INVENTION

The present invention relates to an apparatus which is available for cutting off a sheet like a textile fabric by applying an effectively connected pipe arrangement.

Normally, an automatically controlled sheet cutting apparatus is made available for cutting off a soft sheet like a textile fabric into a predetermined shape. Conventionally, a sheet feeding table, a cutting table, and a sheet take-out table, are sequentially disposed on the plane surface of any conventional sheet cutting apparatus. Typically, such a conventional sheet cutting apparatus incorporates an air absorber and a filtering unit, which are respectively connected to the sheet feeding table, the sheet cutting table, and the sheet take-out table via a number of pipes. Normally, any conventional sheet cutting apparatus is furnished with an endless conveyer unit and an air-absorbing cleaner so that the conveyer unit can be prevented from being clogged with dust.

In order to convey a fabric forward in slightly afloat condition, those conventional feeding tables and take-out tables externally blow air via a number of through holes provided on the surface of these tables. Furthermore, in order to secure the fabric, the fabric is absorbed against the surfaces of these tables provided for the cutting apparatus. The air-absorbing cleaner removes fibrous dust from the endless conveyer by means of absorption.

An air compressing source is provided for the sheet feeding table and also for the sheet take-out table. On the other hand, the cutter unit and the cleaner are respectively provided with an air absorber and a filter. Nevertheless, since the filtering unit itself is gradually clogged with fibrous dust arose from the sheet cutting unit, this in turn results in the increased resistance against absorptive efficiency. To prevent this symptom, such a system for checking the clogged condition of the filtering unit is essential for any of those conventional fabric cutting apparatuses available today. This in turn raises spacewise and costwise problems.

Therefore, the object of the invention is to fully solve those problems mentioned above by providing a novel sheet cutting apparatus which effectively makes use of a first pressure sensor which is normally made available for controlling a blower for specifically detecting clogged condition of each filtering unit provided for the cutting unit and the cleaner.

SUMMARY OF THE INVENTION

According to the sheet cutting apparatus embodied by the invention, after establishing an optional pressure value by operating a pressure setter 91, the number of the rotation of each blower motor is properly controlled in order that the pressure detected by a first pressure sensor D1 can correctly match the pressure preset by the pressure setter 91 by means of absorptive force generated by a blower. An alarm circuit 94 generates alarm signal as soon as the difference of pressure between the first and second pressure sensors D1 and D2 exceeds a specific level predetermined by an alarm level setter 95.

DETAILED DESCRIPTION OF THE PREFERRED EMBODIMENTS

Referring now more particularly to the accompanying drawings, full aspects of the sheet cutting apparatus according to an embodiment of the invention are described below.

Figure 1:
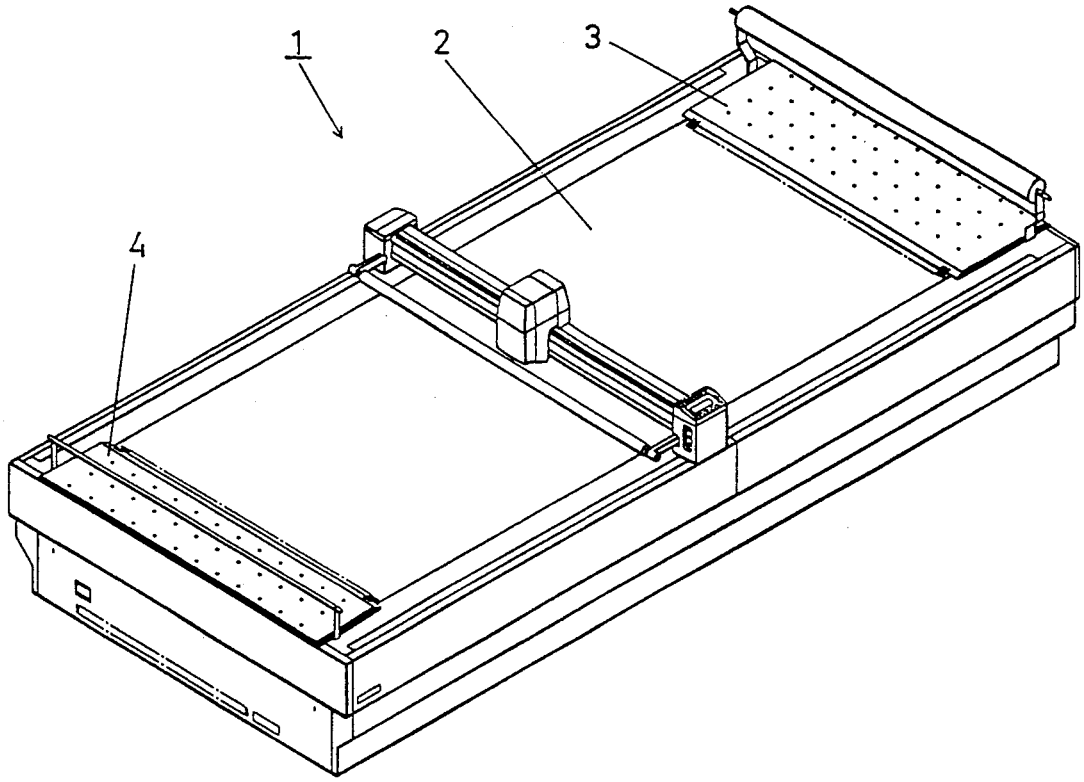
FIG. 1 is an overall perspective view of the sheet cutting apparatus according to an embodiment of the invention.
Figure 2:
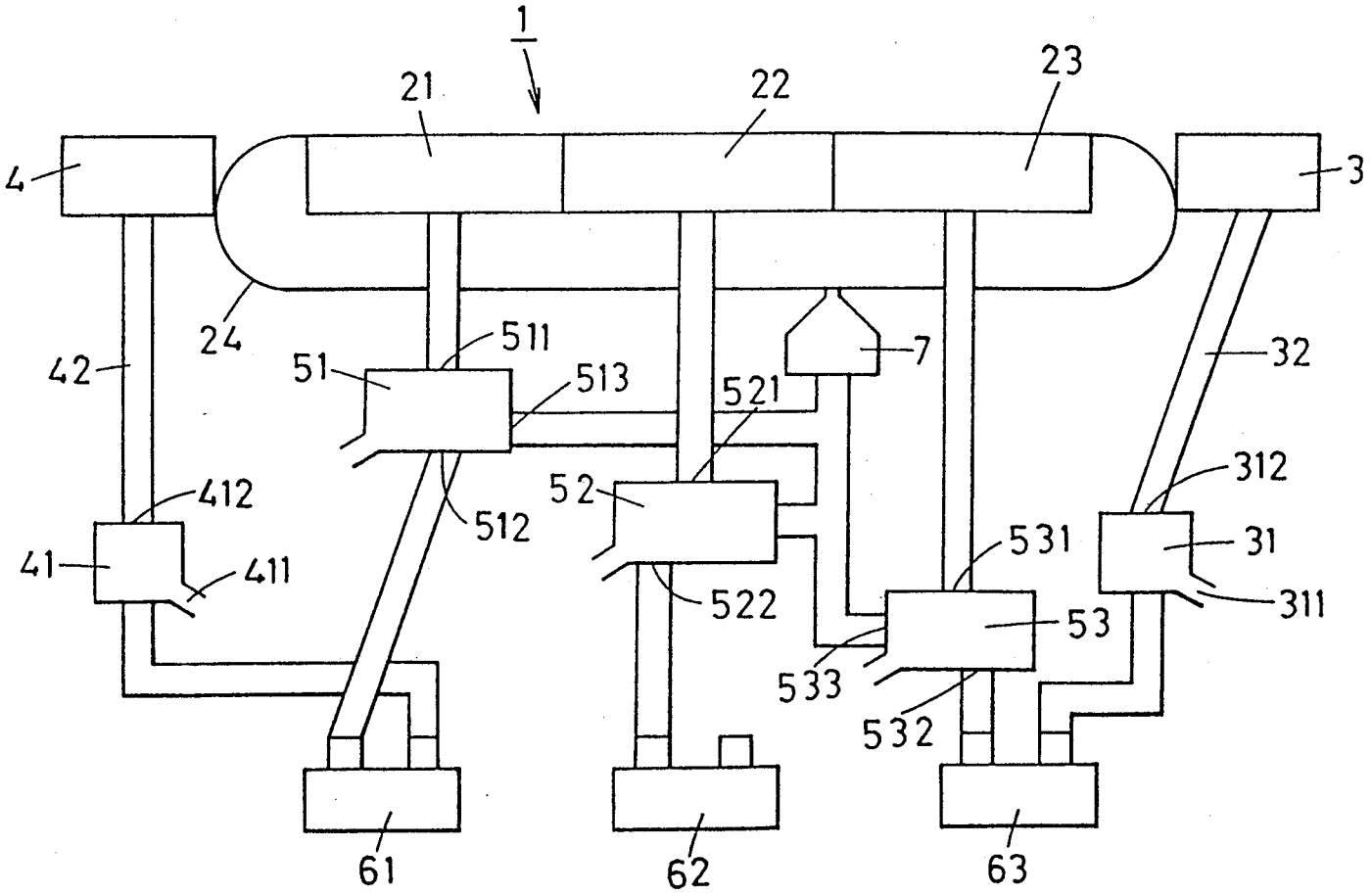
FIG. 2 is a schematic block diagram of pipe arrangement between main components of the sheet cutting apparatus embodied by the invention.

FIG. 1 is an overall perspective view of the sheet cutting apparatus embodied by the invention. FIG. 2 is a schematic block diagram of pipe arrangement between main components of the sheet cutting apparatus embodied by the invention. Referring now to FIGS. 1 and 2, the reference numeral 1 designates the sheet cutting apparatus itself. The reference numeral 2 designates a cutting unit, 3 a sheet feeding table, 4 a sheet take-out table, and 51 through 53 respectively designate a filtering box.

The cutting unit 2 is equipped with an endless-belt conveyer unit 24 and split into three suction chambers 21 through 23. Of these, the first suction chamber 21 is connected to an air inlet 511 of the first filtering box 51 via a pipe. On the other hand, an air outlet 512 of the first filtering box 51 is connected to a suction port of a blower 61. The second suction chamber 22 is connected to an air inlet 521 of the second filtering box 52. An air inlet 522 of the second filtering box 52 is connected to a suction port of another blower 62 via a pipe. The third suction chamber 23 is connected to an air inlet 531 of the third filtering box 53 via a pipe. An air outlet 532 of the third filtering box 53 is connected to a suction port of another blower 63.

Figure 3:
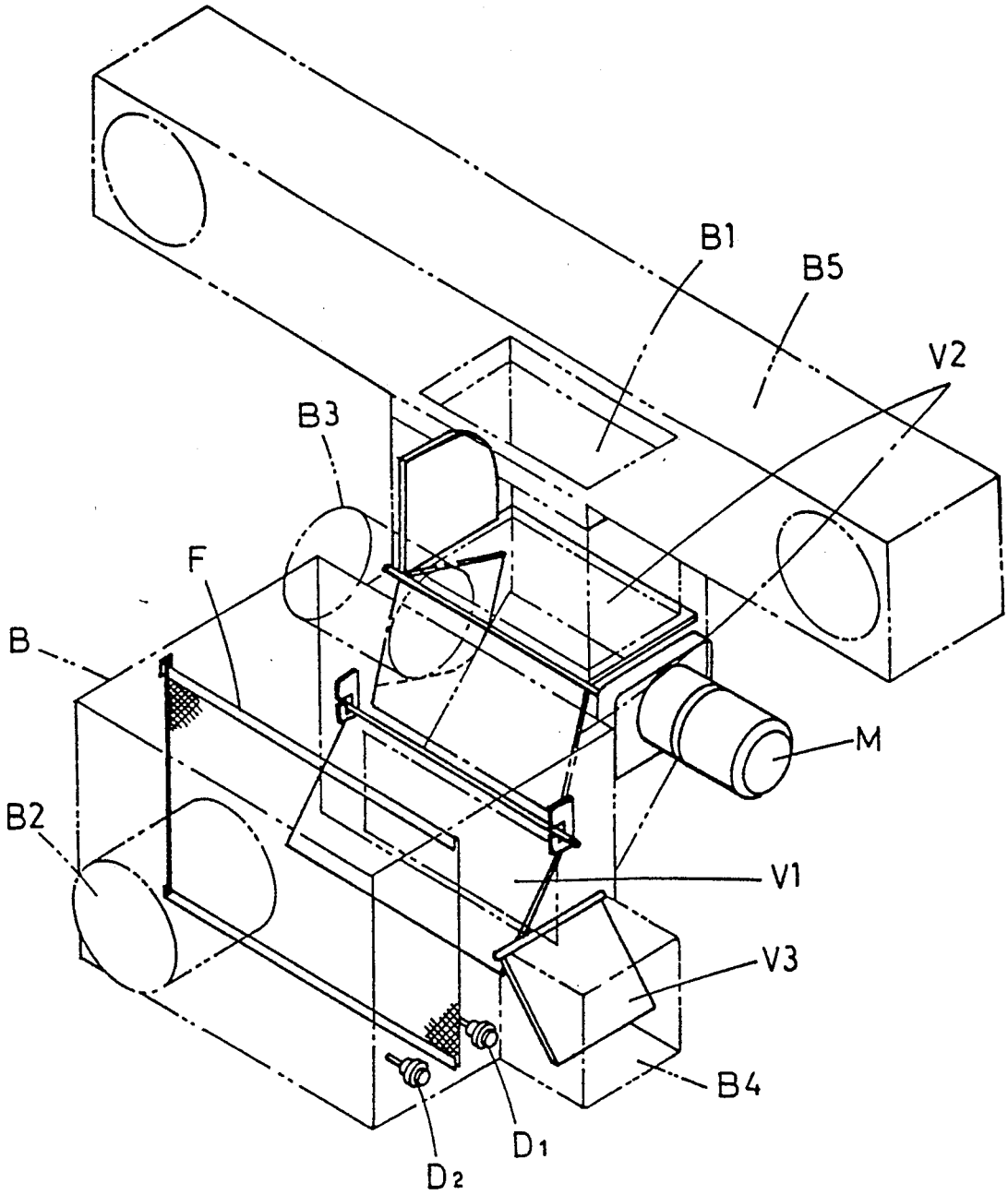
FIG. 3 is explanatory of the structure of a filter box provided for the sheet cutting apparatus embodied by the invention.

Referring now to FIG. 3, structures of those filtering boxes 51 through 53 are described below. Note that the reference character "B" shown in FIG. 3 designates those filtering boxes 51 through 53. Each of those filtering boxes B is provided with the first air inlet B1 which is connected to those suction chambers 21 through 23, the second air inlet B3 which is connected to a cleaner 7, an air outlet B2 which is connected to the blower 62, and an exhaust port B4 which is externally open.

The reference numeral D1 designates a first pressure sensor which detects pressure present in the first air inlet B1 of the filtering box B. The reference numeral D2 designates a second pressure sensor which detects pressure present in the air outlet B2 of the filtering box B.

The reference numeral V1 designates a check valve having such a structure capable of preventing inverse air flow from being generated by opening and closing itself in response to the flow of air, in other words, in response to the normal turn and the reverse turn of blowers.

The reference numeral V2 designates an L-shaped valve which is rotatable by substantially 90 degrees by means of a switching motor M. The L-shaped valve V2 is switchable to two functional positions including the cleaner-absorbing mode shown by means of a solid line and the cutter-absorbing mode shown by means of a broken line.

The reference numeral V3 designates another check valve having such a structure capable of preventing inverse flow of air from being generated by opening and closing itself in response to the flow of air, in other words, in response to the normal turn and the reverse turn of blowers.

The air inlet B1 is linked with a suction chamber B5 so that the suction chamber B5 can be linked with any of those suction chambers 21 through 23.

The reference numeral 7 designates a cleaner unit which absorbs and eliminates fibrous dust from the endless belt conveyer 24. The cleaner unit 7 itself is connected to a second air inlet 533 of the third filtering box 53, and yet, the cleaner unit 7 is also connected to the first and second filtering boxes 51 and 52.

An exhaust port of the blower 61 is connected to an air chamber of the take-out table 4 via an exhaust box 41 which functions as an exhaust switching unit. The exhaust box 41 switches passage of air exhausted from the blower 61 over to an exhaust port 411 or to a connection port 412 on the table side.

Figure 9:
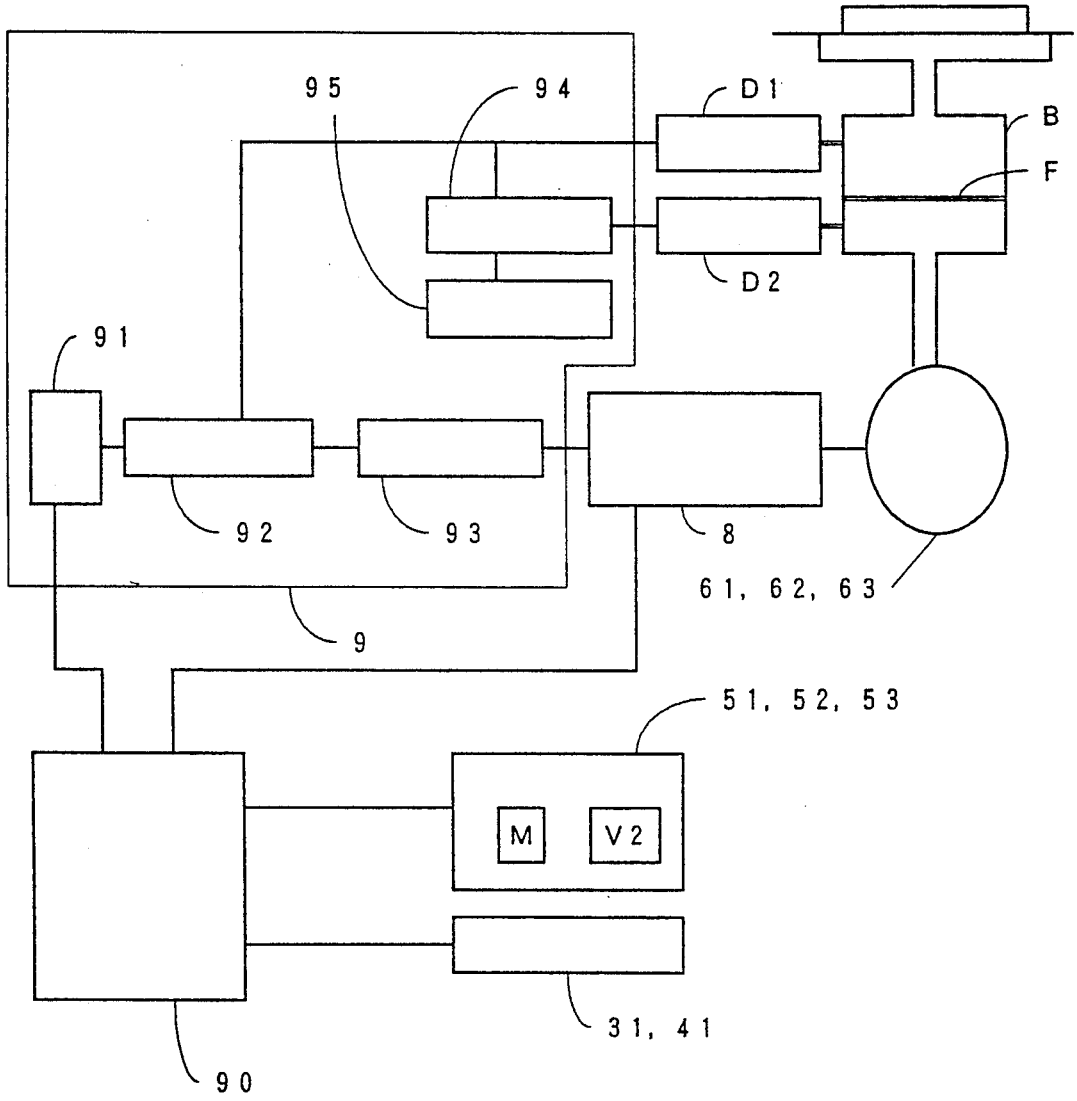
FIG. 9 is a simplified block diagram of the blower control circuit provided for the sheet cutting apparatus embodied by the invention.

The reference numeral 8 shown in FIG. 9 designates an inverter controller which controls operation of those blowers 61 through 63. A blower control circuit 9 controls ON-OFF operations of these blowers 61 through 63, the number and the direction of the rotation of these blowers 61 through 63 clockwise or counterclockwise.

In response to the pressure signal output from the first and second pressure sensors D1 and D2 provided for each filtering box B, the blower control circuit 9 properly controls operations of these blowers 61 through 63. Each of these filtering boxes B incorporates the blower control circuit FIG. 9 designates a simplified block diagram of the block control circuit 9. When a pressure setter 91 establishes an optional pressure value, the pressure setter 91 outputs a signal corresponding to the entered pressure value. Next, a comparative arithmetic operation unit 92 makes a comparison between the output signal and the signal from the first pressure sensor D1. If any difference were present between both output signals, then, the comparative arithmetic operation unit 92 outputs a difference signal. On receipt of the difference signal, a frequency controller 93 varies frequency signal in correspondence with the difference signal, and then controls the number of the rotation of each blower motor via the inverter controller 8. In consequence, the frequency controller 93 properly controls the pressure detected by the first pressure sensor D1 by applying absorptive force generated by each blower so that the controlled pressure can correctly match the pressure preset by the pressure setter 91.

Simultaneously, an alarm circuit 94 makes a comparison between those pressure signals output from the first and second pressure sensors D1 and D2. If the difference of pressure between both output signals were in excess of a reference level preset by an alarm-level setter 95, then the alarm circuit 94 outputs an alarm signal. In response to the output alarm signal, alarm lamp flashes or acoustic alarm is generated.

When the alarm signal is generated, the cutting apparatus switches the pipe arrangement based on a routine described later on, and then executes an operation to clean the filtering box to cause the alarm signal to be reset.

A controller 90 individually controls functional operation of the blower control circuit 9, the L-shaped valve V2 provided as a suction switching unit for each filtering box, the switching motor M, and a pair of exhaust boxes 31 and 41 which are respectively available for switching exhaust passage.

Next, functional operations of the sheet cutting apparatus embodied by the invention are described below in reference to the cleaning of each filtering box, delivery of a cuttable fabric, the cutting operation, and the external delivery of the cut-off fabric.

Figure 4:
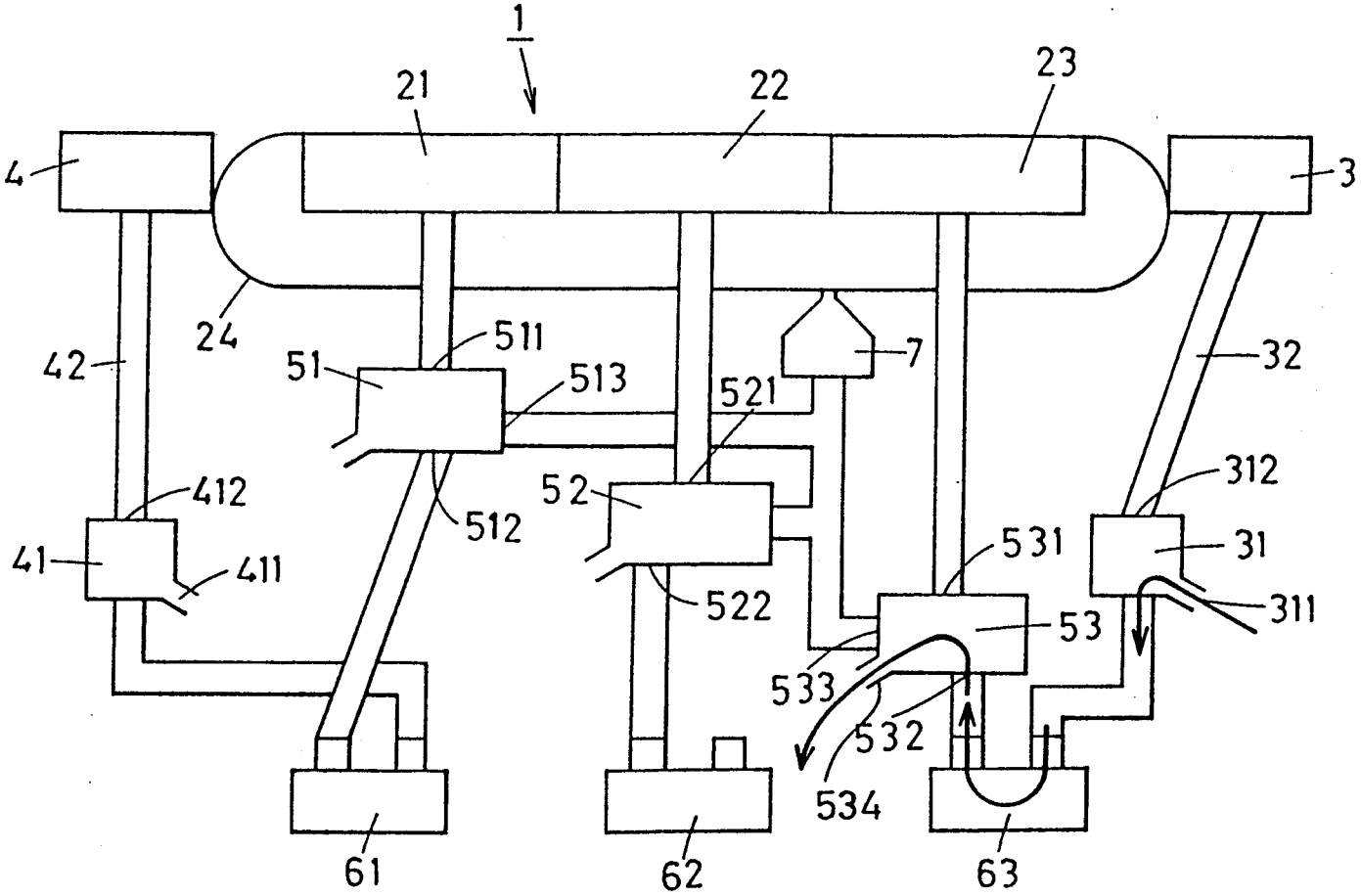
FIG. 4 is explanatory of the flow of air when cleaning a filtering unit provided for the sheet cutting apparatus embodied by the invention.

FIG. 4 schematically illustrates the flow of air on the way of eliminating fibrous dust from the interior of each filtering box.

Initially, the exhaust box 31 is switched over to the exhaust port 311 to close a pair of air inlets 531 and 533 of the filtering box 53. Next, a control signal from the controller 90 reverses the rotation of the blower 63 so that the interior of the filtering box 53 can be cleaned in the inverse direction by means of externally absorbed air. In consequence, fibrous dust is fully absorbed from the cleaner 7 and respective suction chambers in conjunction with absorbed air before eventually being discharged from the exhaust port 534. The inverter controller 83 properly controls operation when reversing the rotation of the blower 63.

Figure 5:
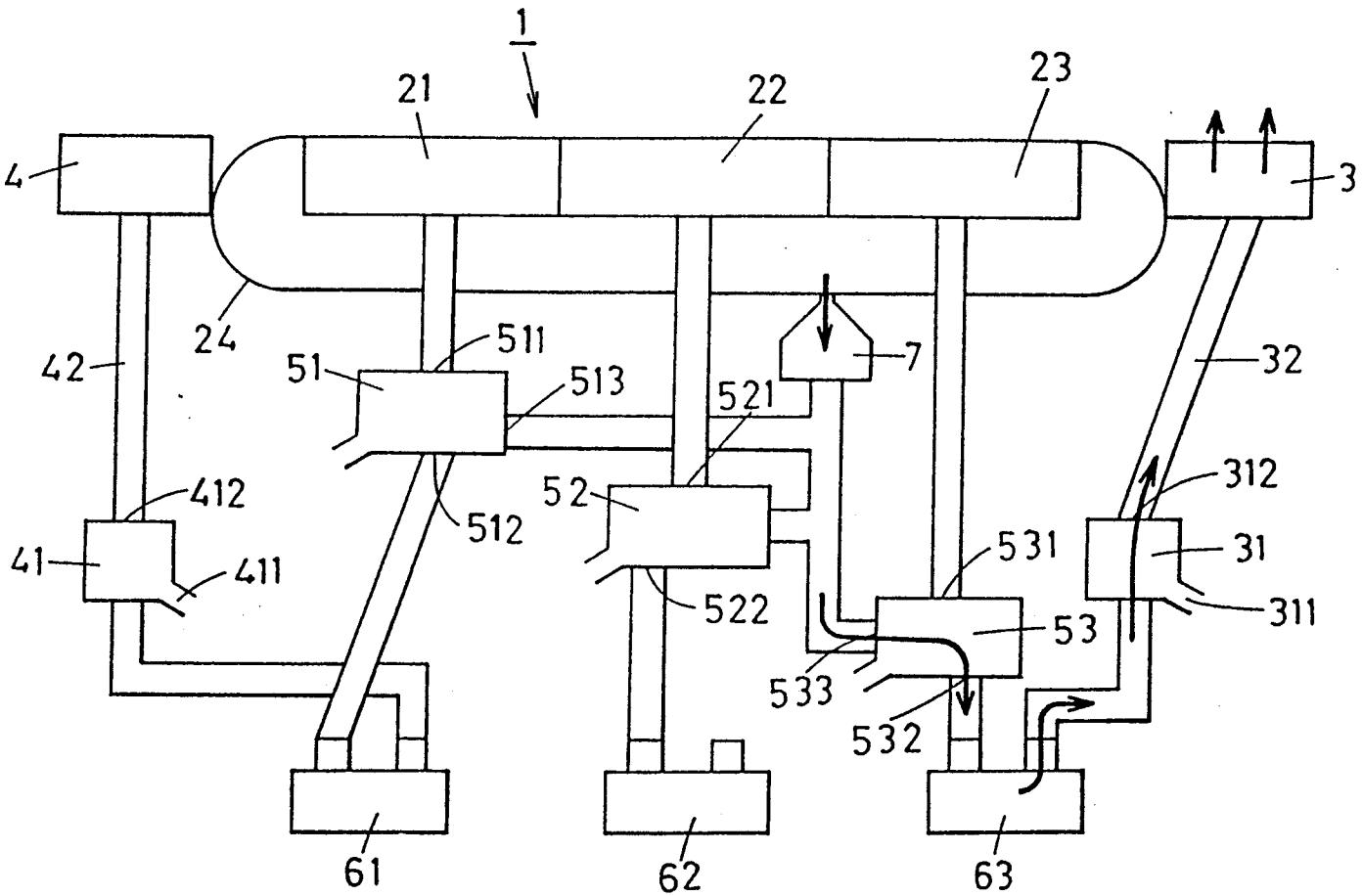
FIG. 5 is explanatory of the flow of air when feeding a textile fabric to the sheet cutting apparatus embodied by the invention.

FIG. 5 schematically illustrates the flow of air when internally feeding a cuttable fabric to the feeding table 3.

When internally feeding a fabric to the feeding table 3, initially, the control signal from the controller 90 slowly rotates the blower 63 in the normal direction. Simultaneously, the switching motor M provided for the filtering box 53 activates operation of the L-shaped valve V2. This in turn closes the air inlet 531 of the filtering box 53 and opens the air inlet 533, and yet, switches the exhaust box 31 to the air outlet 312 on the table side.

Air absorbed via the cleaner 7 flows into the filtering box 53 through the air inlet 533, where the filtering box 53 catches fibrous dust. The filtered air is then led to the air outlet 532 before being absorbed by the blower 63. On the other hand, exhaust air is led to the feeding table 3 from the table-side outlet 312 of the exhaust box 31 via the exhaust supply pipe 32 before eventually being blown out of a blow-off hole.

In consequence, fibrous dust is eliminated from the endless belt conveyer 24 before being caught by the filtering box 53. On the other hand, the feeding table 3 internally feeds a cuttable fabric by slightly floating it from the table surface.

Figure 6:
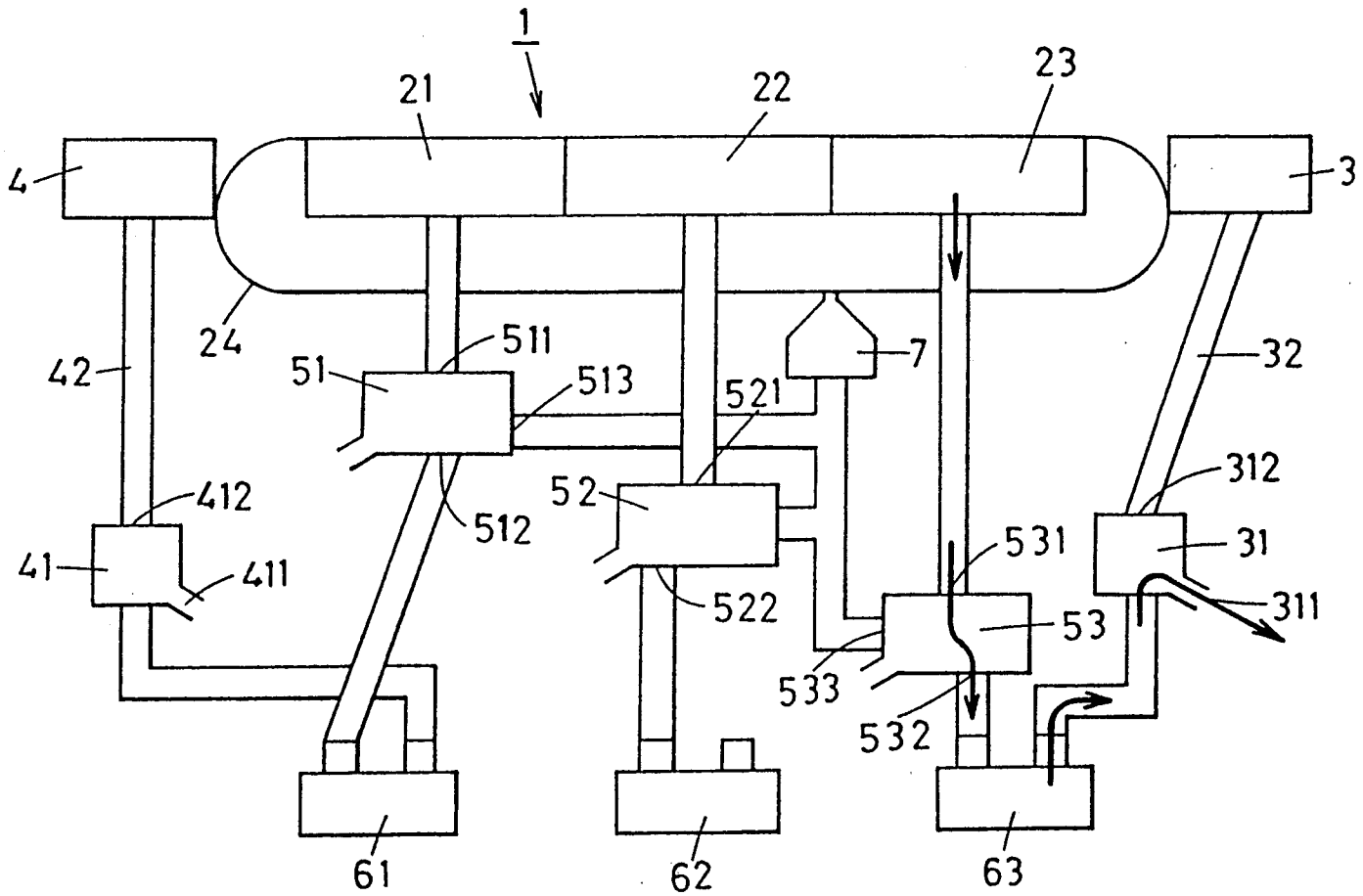
FIG. 6 is explanatory of the flow of air when cutting off a textile fabric with the cutting unit of the apparatus embodied by the invention.

FIG. 6 schematically illustrates the flow of air when cutting off the fabric in the suction chamber 23. In this case, in order to fully gain absorptive force in the cutting unit 2, the blower 63 is driven at a specific number of rotation enough to gain pressure predetermined by the blower control circuit 9.

Simultaneously, the L-shaped valve V2 is operated by the switching motor M provided for the filtering box 53 to open the air inlet 531 of the filtering box 53 and then close the air inlet 533 so that the exhaust box 31 can be switched over to the exhaust port 311.

Air absorbed in the suction chamber 23 is then led to the filtering box 53 to permit it to instantaneously catch fibrous dust. Then, exhaust air is led out of the exhaust box 31 via the exhaust port 311.

While an operation for cutting off the fabric is under way in the suction chamber 23, since only a short part is cut, even when the blower 63 rotates at a constant number of the rotation, internal pressure of the suction chamber 23 is decreased to cause the absorptive force against the objective fabric to be intensified beyond the optimal level. This in turn causes the first pressure sensor D1 to detect the varied pressure resulted from the decreased pressure. Next, the comparative arithmetic operation unit 92 makes a comparison between the varied pressure and the preset reference pressure to cause the frequency controller 93 to output lowered frequency. In consequence, the number of the rotation of the blower motor is decreased to also decrease the absorptive force of the blower 63. This in turn permits the pressure in the suction chamber 23 to restore normal level of pressure, thus restoring optimal operating condition. Since the number of the rotation of the blower 63 decreases during the cutting operation, consumable power is effectively saved.

Conversely, if the absorptive force against the objective fabric in the suction chamber 23 ever decreases below the optimal level, then the first pressure sensor D1 detects that the decreased amount of pressure is still short. As a result, the control system boosts the number of the rotation of the blower motor to promote decompression furthermore. This in turn intensifies absorptive force of the blower 63 so that the absorptive force against the objective fabric can fully be restored to optimal level. In consequence, the cutting apparatus embodied by the invention can stably cut off the fabric without incurring shortage of absorptive force.

Therefore, the pressure being detected by the first pressure sensor D1 is constantly held at a predetermined level, and thus, the pressure can hardly be lowered below the predetermined level. In other words, the cutting apparatus does not generate excessive absorptive force to result in the economy of power consumption as another aspect of advantage. Furthermore, since the absorptive force remains quite sufficient, the cutting apparatus can stably cut off the fabric while the cutting operation is underway. Blowers 62 and 63 are respectively subject to the control processes described above.

Next, when the cutting area shifts from the suction chamber 23 to the suction chamber 22, the controller stops the rotation of the blower 63, and simultaneously starts to rotate the blower 62 in the normal direction. At the same time, dusty air absorbed in the suction chamber 22 is led to the filtering box 52, which then catches fibrous dust before eventually discharging the filtered air from it.

Figure 7:
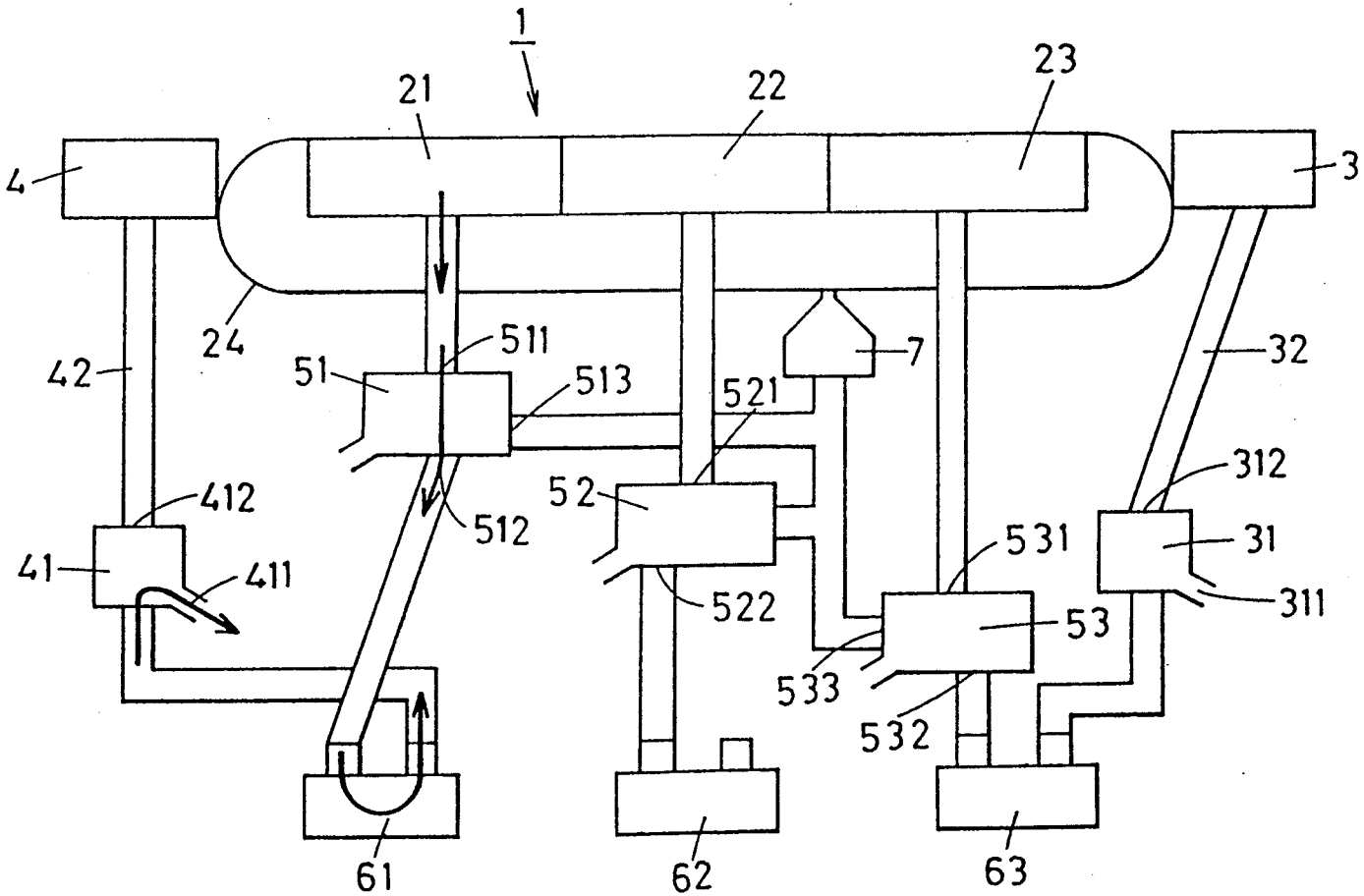
FIG. 7 is explanatory of the flow of air when cutting off a textile fabric with the cutting unit of the apparatus embodied by the invention.

FIG. 7 schematically illustrates the flow of air in the state in which the cutting area is shifted from the suction chamber 22 to the suction chamber 21. In this case, those blowers 62 and 63 are respectively brought to a stop, whereas only the blower 61 rotates in the normal direction. The controller opens the air inlet 511 of the filtering box 51 and closes the air inlet 513, and then, switches the exhaust box 41 over to the exhaust port 411.

Dusty air led out of the suction chamber 21 then flows into the filtering box 51, which instantaneously catches all the fibrous dust. Dust-free air then discharged from the exhaust port 411 of the exhaust box 41.

Figure 8:
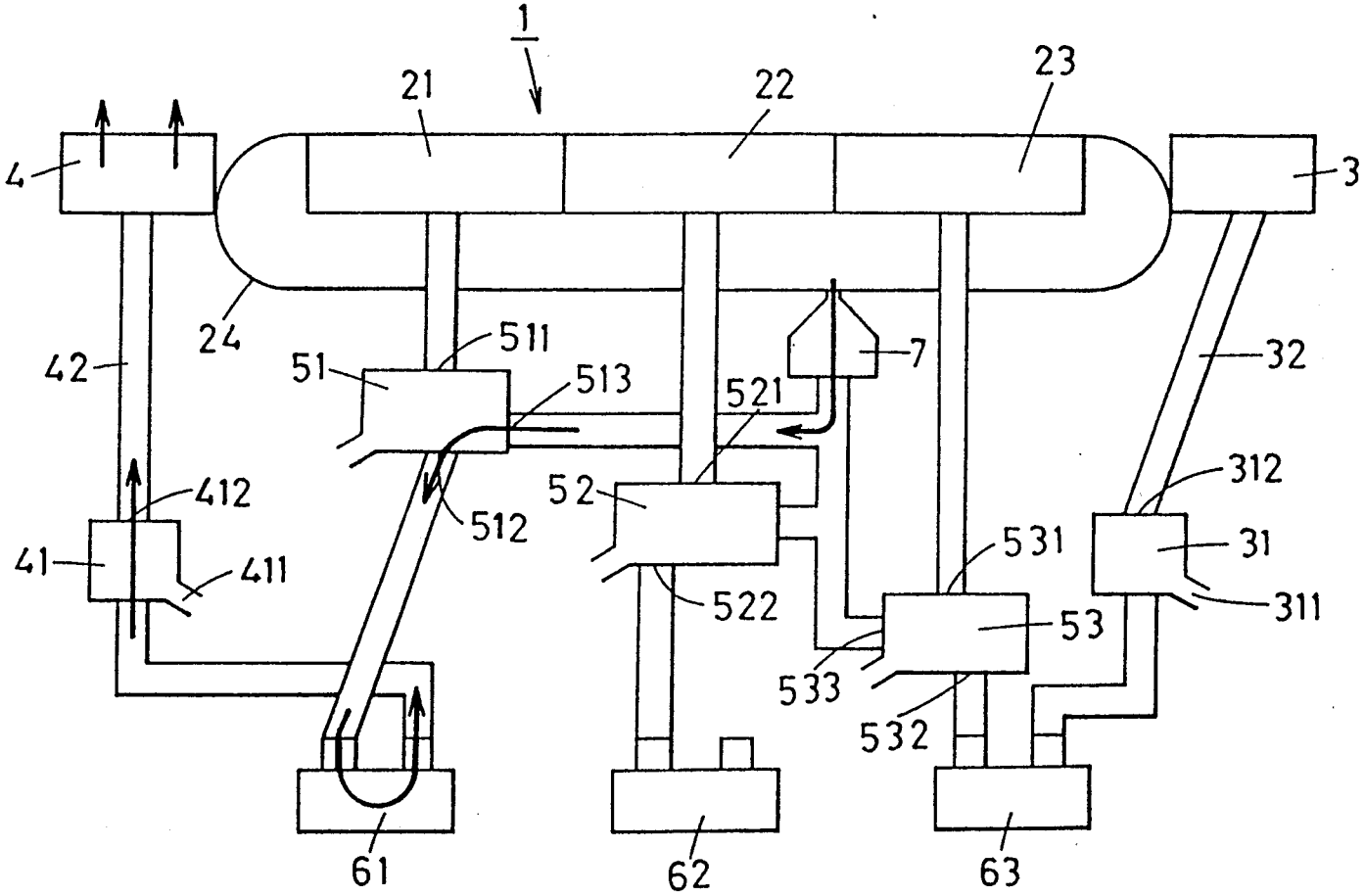
FIG. 8 is explanatory of the flow of air when taking the cut-off textile fabric out of the sheet cutting apparatus embodied by the invention.

FIG. 8 schematically illustrates the flow of air when taking the cut fabric out of the take-out table 4. On the way of taking the cut fabric out of the take-out table 4, the controller slowly rotates the blower 61 in the normal direction, and simultaneously operates the L-shaped valve V2 by activating the switching motor M provided for the filtering box 51. This in turn closes the air inlet 511 of the filtering box 51, opens the air inlet 513, and then switches the exhaust box 41 over to the exhaust port 412 on the part of the take-out table 4.

Air absorbed via the cleaner 7 flows into the filtering box 51 through the air inlet 513. The filtering box 51 then catches fibrous dust, and then permits the filtered air to be absorbed in the blower 61 via the air outlet 512. Finally, dust-free air is led to the take-out table 4 from the exhaust port 412 of the exhaust port 412 of the exhaust box 41 via the exhaust feeding pipe 42 before eventually being discharged from a blow-off hole.

Therefore, fibrous dust is fully eliminated from the endless belt conveyer 24 before being caught by the filtering box 51. On the other hand, the cut fabric is easily released from the take-out table 4 in the state slightly being afloat above the table surface.

As is clear from the foregoing description, the sheet cutting apparatus embodied by the invention outputs alarm signal whenever the signal designating the differential pressure between the first and second pressure sensors D1 and D2 exceeds the predetermined pressure level. In consequence, the cutting apparatus embodied by the invention automatically detects clogged symptom generated in filters, thus enabling the factory operator to efficiently and smoothly carry on the cutting operation.

Furthermore, factory operator can execute cleaning of all the filters availing of alarm signal by reversing the rotation of those blowers 61 through 63. Factory operator may clean filtering units everyday before entering the cutting operation.

Furthermore, the cutting apparatus embodied by the invention incorporates a device for switching the direction of the rotation of each blower clockwise or counterclockwise. When any of those blowers 61 through 63 rotates in the counterclockwise direction, air blown out of suction port is inversely blown through filtering units before externally being discharged In other words, inversely blown air is externally discharged together with fibrous dust caught in the filtering box.

This in turn prevents filtering units from being clogged with fibrous dust to enable the cutting apparatus to smoothly operate itself in a stable condition while effectively executing filtering operation based on constantly available high performance.

What is claimed is:

1. A sheet cutting apparatus comprising:

a cutting unit which includes an airpermeable table for mounting a sheet subject to a cutting process;

at least one suction chamber juxtaposed said airpermeable table;

at least one blower which respectively blows air received from a suction port of said at least one said suction chamber out of an exhaust port of said at least one blower;

a plurality of air passage pipes which interlink each suction port with said at least one suction chamber of said cutting unit;

a plurality of filtering units which are respectively disposed on one each of said air passage pipes;

a first pressure sensor which is provided for each of said filtering units on a part of said cutting unit; and a blower control means for controlling a rotation of said at least one blower in order that a pressure on a part of said cutting unit detected by said first pressure sensor correctly matches a predetermined suction pressure;

wherein said cutting apparatus further comprises a second pressure sensor which is installed on each of said filtering units on a part of said at least one blower; and an alarm means for said at least one suction chamber which initially makes a comparison between those signals output from said first pressure sensor and said second pressure sensor, and if a different between both signals ever exceeds a predetermined difference of pressure, instantaneously generates an alarm signal.

2. A sheet cutting apparatus as claimed in claim 1 which includes a plurality of suction chambers and a plurality of blowers.

3. A sheet cutting apparatus comprising:

a cutting unit which includes an airpermeable table for mounting a sheet subject to a cutting process;

at least one suction chamber juxtaposed said airpermeable table;

at least one blower which respectively blows air received from a suction port of said at least one suction chamber out of an exhaust port of said at least one blower;

a plurality of air passage pipes which interlink each suction port with said at least one suction chamber of said cutting unit;

a plurality of filtering units which are disposed on one each of said air passage pipes;

a first pressure sensor which is provided for each of said filtering units on a part of said cutting unit; and a blower control means for controlling a rotation of said at least one blower in order that a pressure on a part of said cutting unit detected by said first pressure sensor correctly matches a predetermined absorptive pressure;

wherein said first pressure sensor comprises a cleaner unit which absorbs dusty matter generated by operation of said cutting unit, and said cutting apparatus further comprises a second pressure sensor which is installed on each of said filtering units on a part of said at least one blower; and an alarm means which initially makes a comparison between output signals from said first pressure sensor and said second pressure sensor, and if a difference between both signals ever exceeds a predetermined difference of pressure, instantaneously generates an alarm signal.

4. A sheet cutting apparatus as claimed in claim 3 which includes a plurality of suction chambers and a plurality of blowers.

* * * * *